US009488950B2

(12) United States Patent
Ichikawa et al.

(10) Patent No.: US 9,488,950 B2
(45) Date of Patent: Nov. 8, 2016

(54) CONTACT MEMBER, IMAGE HOLDING MEMBER, AND IMAGE FORMING APPARATUS

(71) Applicant: FUJI XEROX CO., LTD., Tokyo (JP)

(72) Inventors: Tomoya Ichikawa, Kanagawa (JP); Yu Tsuda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/621,849

(22) Filed: Feb. 13, 2015

(65) Prior Publication Data

US 2016/0026143 A1 Jan. 28, 2016

(30) Foreign Application Priority Data

Jul. 24, 2014 (JP) ..... 2014-151143

(51) Int. Cl.

*G03G 15/02* (2006.01)
*G03G 15/00* (2006.01)
*G03G 21/16* (2006.01)

(52) U.S. Cl.

CPC ..... *G03G 15/751* (2013.01); *G03G 15/75* (2013.01); *G03G 21/1671* (2013.01); *G03G 2221/1606* (2013.01)

(58) Field of Classification Search

CPC .. G03G 15/75; G03G 15/751; G03G 15/754; G03G 21/1671; G03G 2221/1606
USPC ..... 399/116, 117, 159, 164, 165
See application file for complete search history.

(56) References Cited

U.S. PATENT DOCUMENTS 5,446,525 A * 8/1995 Kobayashi ..... G03G 15/751 399/111
6,438,338 B1 * 8/2002 Mark et al. ..... 399/91
2001/0032835 A1 * 10/2001 Murooka et al. ..... 219/216

FOREIGN PATENT DOCUMENTS

JP 2001154389 A * 6/2001 ..... G03G 5/10
JP 2002-116661 A 4/2002
JP 2002-207396 A 7/2002
JP 2007316203 A * 12/2007 ..... G03G 21/00
JP 2008-262076 A 10/2008
JP 2009-042440 A 2/2009
JP 2012-098539 A 5/2012

OTHER PUBLICATIONS

Aug. 4, 2015 Office Action issued in Japanese Patent Application No. 2014-151143.
Oct. 20, 2015 Office Action issued in Japanese Patent Application No. 2014-151143.

* cited by examiner

*Primary Examiner* — Benjamin Schmitt
(74) *Attorney, Agent, or Firm* — Oliff PLC

(57) ABSTRACT

Provided is a contact member that comes in contact with an inner surface of a cylindrical member being rotated to press against the inner surface, is supported within the cylindrical member, is provided along the inner surface when viewed in an axial direction of the cylindrical member while being supported by the cylindrical member, has an arc shape in which both ends thereof face each other, and has first thin-wall regions which are respectively formed at both ends thereof in a circumferential direction to have thicknesses lower than thicknesses of other regions.

14 Claims, 11 Drawing Sheets

CONTACT MEMBER, IMAGE HOLDING MEMBER, AND IMAGE FORMING APPARATUS

CROSS-REFERENCE TO RELATED APPLICATIONS

This application is based on and claims priority under 35 USC 119 from Japanese Patent Application No. 2014-151143 filed Jul. 24, 2014.

BACKGROUND

Technical Field

The present invention relates to a contact member, an image holding member, and an image forming apparatus.

SUMMARY

According to an aspect of the invention, there is provided a contact member that comes in contact with an inner surface of a cylindrical member being rotated to press against the inner surface, is supported within the cylindrical member, is provided along the inner surface when viewed in an axial direction of the cylindrical member while being supported by the cylindrical member, has an arc shape in which both ends thereof face each other, and has first thin-wall regions which are respectively formed at both ends thereof in a circumferential direction to have thicknesses lower than thicknesses of other regions.

BRIEF DESCRIPTION OF THE DRAWINGS

Exemplary embodiments of the present invention will be described in detail based on the following figures, wherein.

DETAILED DESCRIPTION

<First Exemplary Embodiment>

Figure 1B:
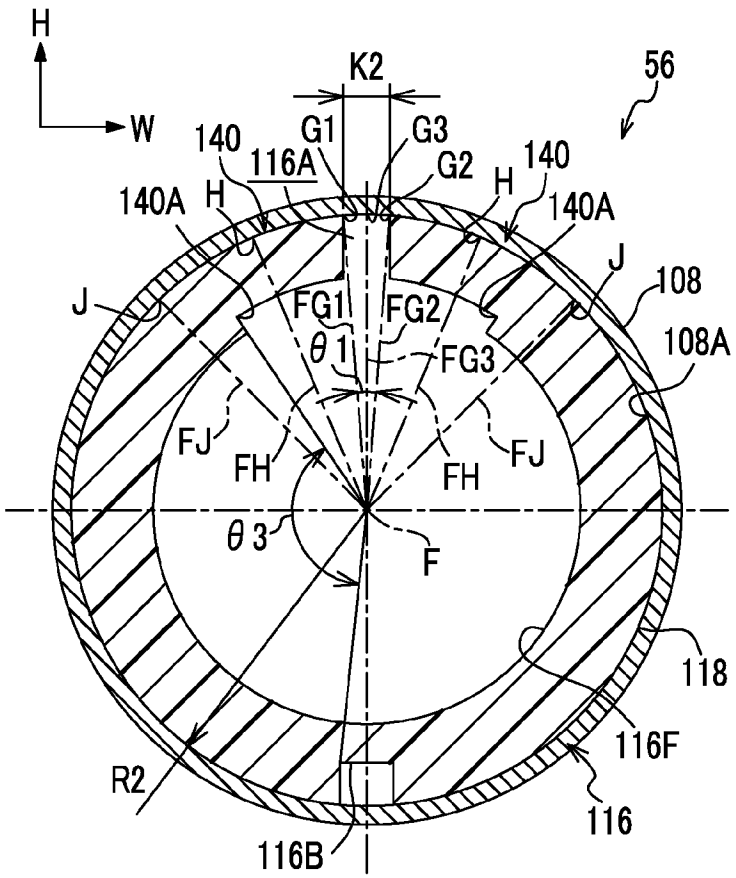
FIGS. 1A and 1B are cross-sectional views showing a contact member according to a first exemplary embodiment of the present invention.

Examples of a contact member, an image holding member and an image forming apparatus according to the first exemplary embodiment of the present invention will be described with reference to FIGS. 1A to 9. In the drawings, arrow H indicates a vertical direction of the apparatus (perpendicular direction), arrow W indicates a width direction of the apparatus (horizontal direction), and arrow D indicates a depth direction of the apparatus (horizontal direction).

Entire Configuration

Figure 6:
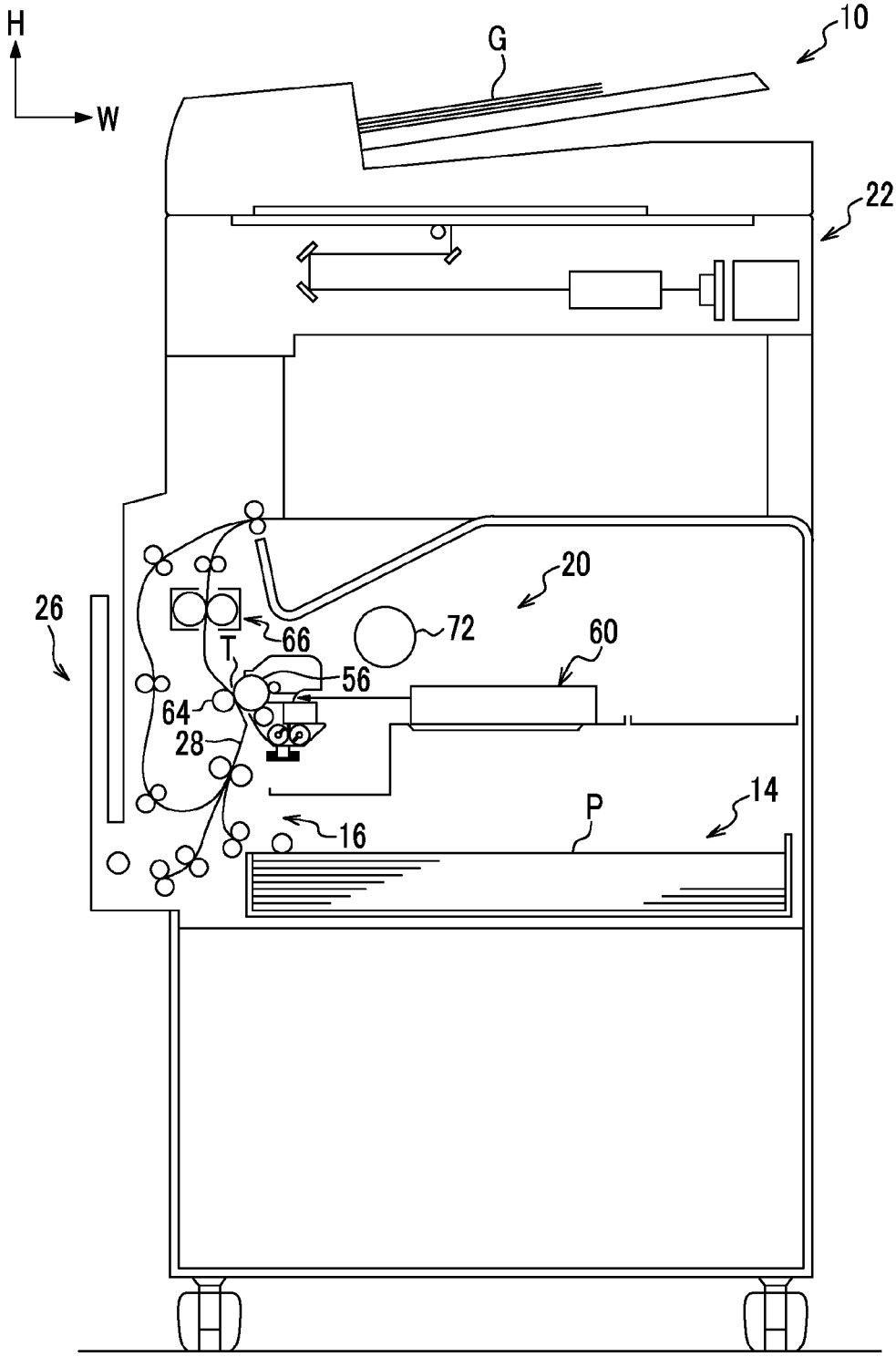
FIG. 6 is a schematic configuration diagram showing an image forming apparatus according to the first exemplary embodiment of the present invention.

As shown in FIG. 6, an image forming apparatus 10 according to the present exemplary embodiment includes a storage unit 14 that stores sheet members P as a recording medium, a transport unit 16 that transports the sheet member P stored in the storage unit 14 along a transport path 28, an image forming unit 20 that forms an image on the sheet member P transported from the storage unit 14 by the transport unit 16, and a document reading unit 22 that reads document G. The storage unit 14, the transport unit 16, the image forming unit 20 and the document reading unit 22 are sequentially arranged within the image forming apparatus 10 from a lower side toward an upper side in the upward and downward direction (arrow H direction). The image forming apparatus 10 further includes a manual feed unit 26 that manually feeds the sheet member P.

Image Forming Unit

Figure 5:
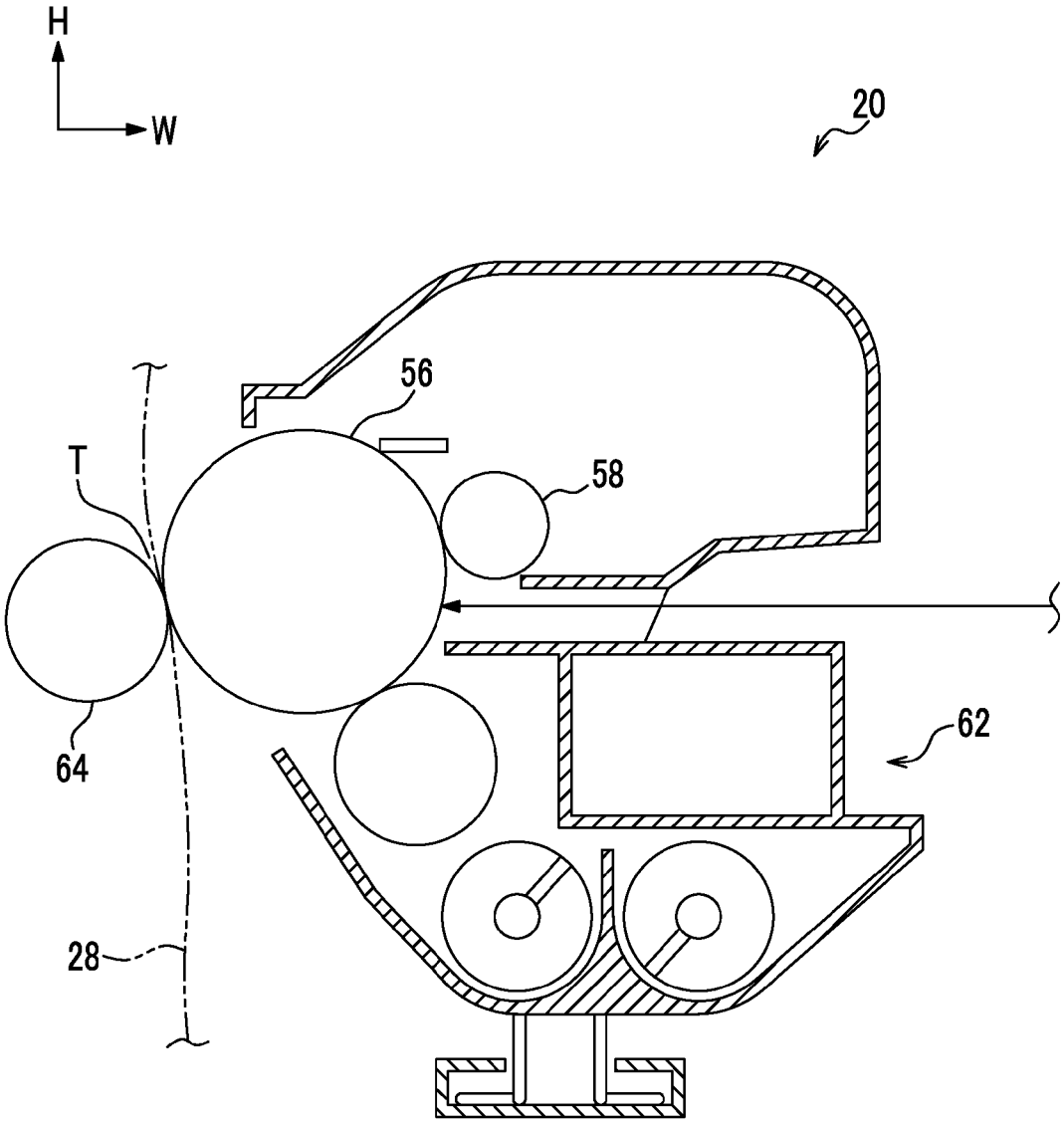
FIG. 5 is a configuration diagram showing the image holding member and the like according to the first exemplary embodiment of the present invention.

As shown in FIG. 5, the image forming unit 20 includes a columnar image holding member 56, a charge roll 58 (an example of a charge member) that charges a surface of the image holding member 56, an exposure device 60 (an example of an image forming member: see FIG. 6) that irradiates the charged surface of the image holding member 56 with exposure light so as to form an electrostatic latent image based on image data, and a developing device 62 (an example of an image forming member) that develops the electrostatic latent image so as to visualize the electrostatic latent image as a toner image.

The image forming unit 20 includes a transfer roll 64 that transfers the toner image formed on the surface of the image holding member 56 onto the sheet member P transported along the transport path 28, and a fixing device 66 (see FIG. 6) that heats and pressurizes the toner image on the sheet member P to fix the toner image onto the sheet member P.

As shown in FIG. 6, a toner cartridge 72 connected to the developing device 62 through a non-illustrated feed pipe is disposed on an oblique upper side of the exposure device 60. Toner that is supplied to the developing device 62 through the feed pipe is stored in the toner cartridge 72.

In such a configuration, the sheet member P fed from the storage unit 14 to the transport path 28 by the transport unit 16 is transported to a transfer position T including the image holding member 56 and the transfer roll 64, and is transported to be nipped between the image holding member 56 and the transfer roll 64. Thus, the toner image formed on the image holding member 56 is transferred onto the sheet member P. The fixing device 66 fixes the toner image transferred onto the sheet member P onto the sheet member P, and the sheet member P on which the toner image is fixed is ejected from the apparatus to the outside.

Configuration of Major Components

Next, the image holding member 56, the charge roll 58 and the like will be described.

Charge Roll

Figure 4:
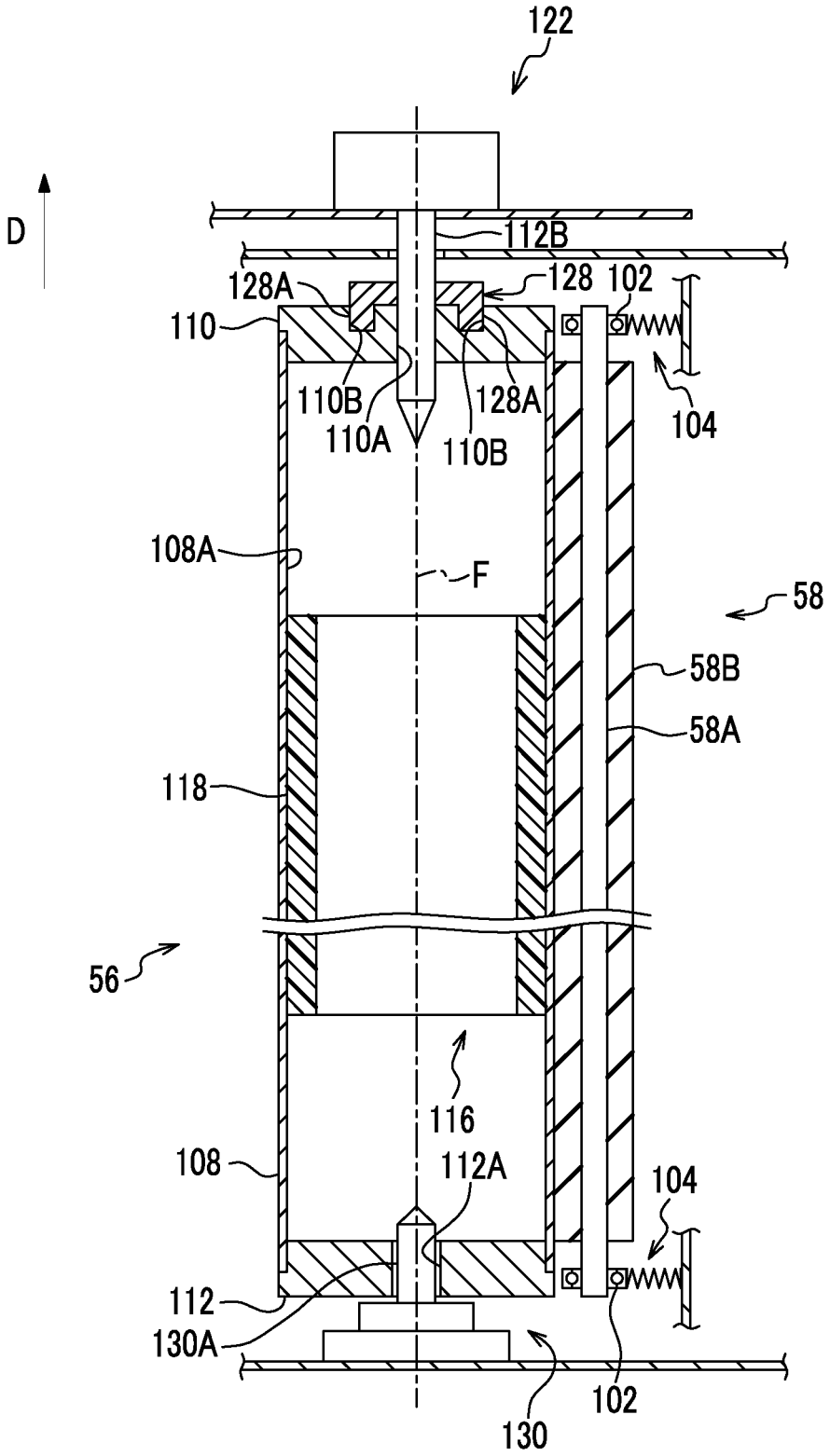
FIG. 4 is a cross-sectional view showing an image holding member according to the first exemplary embodiment of the present invention.

As shown in FIG. 4, the charge roll 58 includes a shaft 58A that extends in the apparatus depth direction and is made from a metal material (for example, stainless steel), and a cylindrical roll 58B through which the shaft 58A penetrates and that is made from a rubber material.

Portions of both ends of the shaft 58A are exposed from the roll 58B to the outside, and are rotatably supported by a pair of bearing members 102. Urging members 104 that respectively urge the bearing members 102 toward the image holding member 56 are arranged on an opposite side of the image holding member 56 with the shaft 58A interposed therebetween.

With such a configuration, when the roll 58B of the charge roll 58 is pressed by the image holding member 56 and the image holding member 56 is rotated, the charge roll 58 is accordingly rotated. By applying a superimposed voltage in which an alternating current voltage (1 kHz to 2 kHz) is superimposed on a direct current voltage to the shaft 58A from a non-illustrated power supply, a current flows to the image holding member 56 from the charge roll 58, and the surface of the image holding member 56 is charged.

Image Holding Member

As shown in FIG. 4, the image holding member 56 includes a cylindrical member 108 that has a cylindrical shape and extends in the apparatus depth direction, and a transmission member 110 that is fixed to the cylindrical member 108 so as to close an opening of the cylindrical member 108 on one end side (upper side in the drawing) in the apparatus depth direction (the same direction as an axial direction of the cylindrical member 108). The image holding member 56 includes a support member 112 that is fixed to the cylindrical member 108 so as to close an opening of the cylindrical member 108 on the other side (lower side in the drawing) in the apparatus depth direction. The image holding member 56 includes a contact member 116 that is disposed inside the cylindrical member 108 and suppresses the vibration of the cylindrical member 108.

The cylindrical member 108 is obtained by forming a photosensitive layer on an outer circumferential surface of a base material formed in a cylindrical shape using aluminum which is a metal material. For example, a thickness of the cylindrical member 108 is set to 0.8 [mm], an outer diameter of the cylindrical member 108 is set to 23 [mm], and a length of the cylindrical member 108 in the apparatus depth direction is set to 250 [mm]. A coefficient of linear expansion of the aluminum is set to $23\times10^{-6}$/K.

The transmission member 110 is formed in a disc shape using a resin material, and is partially fitted into the cylindrical member 108 to be fixed to a portion on the one end side of the cylindrical member 108. A columnar through hole 110A is formed in the transmission member 110 on an axial center F of the cylindrical member 108. Plural concave portions 110B are formed in an outer surface of the transmission member 110 facing the outside in the apparatus depth direction so as to interpose the through hole 110A therebetween.

A motor shaft 122B of a motor 122 that generates rotational force transmitted to the transmission member 110 (image holding member 56) penetrates through the through hole 110A of the transmission member 110. Front ends 128A of a bracket 128 attached to the motor shaft 122B are bent to be inserted into the concave portions 110B of the transmission member 110.

The support member 112 is formed in a disc shape using a resin material, and is partially fitted into the cylindrical member 108 to be fixed to a portion of the other end side of the cylindrical member 108. A columnar through hole 112A is formed in the support member 112 on the axial center F of the cylindrical member 108.

A shaft 130A of a shaft member 130 that rotatably supports the support member 112 (image holding member 56) penetrates the through hole 112A, and the support member 112 functions as a so-called slippage bearing for the shaft 130A.

In such a configuration, rotational force generated by the motor 122 is transmitted to the transmission member 110 (image holding member 56) through the bracket 128, and the image holding member 56 is rotated about the axial center F.

Contact Member

Next, the contact member 116 which is supported within the cylindrical member 108 will be described.

As shown in FIG. 4, the contact member 116 is fitted into the cylindrical member 108 to be supported in a center of the cylindrical member 108 in the apparatus depth direction. As shown in FIG. 1B, an arc-shaped outer circumferential surface 118 of the contact member 116 comes in contact with an inner surface 108A of the cylindrical member 108 so as to press against the inner surface 108A, and, thus, the contact member 116 is supported by the cylindrical member 108.

Figure 2:
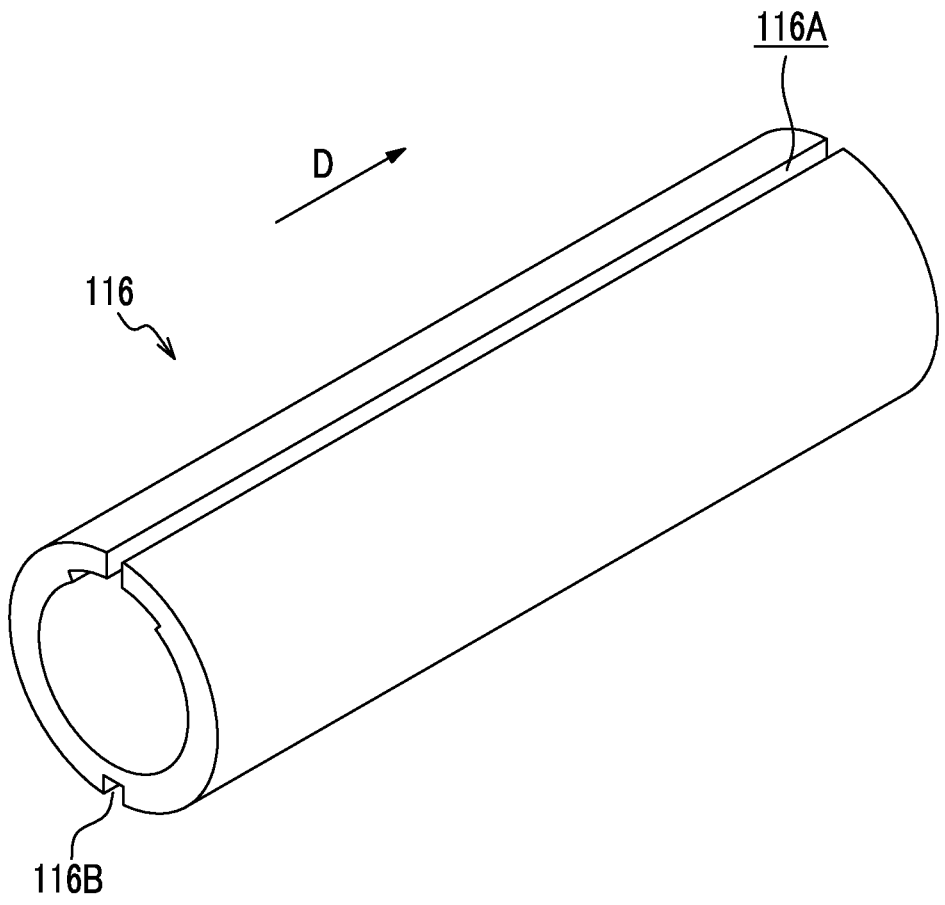
FIG. 2 is a perspective view showing the contact member according to the first exemplary embodiment of the present invention.

Specifically, the contact member 116 is formed using an ABS resin (acrylonitrile-butadiene-styrene) which is a resin material. While the contact member 116 is supported within the cylindrical member 108, the contact member 116 is formed in a C shape (arc shape) in which both ends face each other along the inner surface 108A of the cylindrical member 108 when viewed in the apparatus depth direction. The space where the both facing ends are separated from each other in the circumferential direction is a separation space 116A. As shown in FIG. 2, the contact member 116 extends in the apparatus depth direction. For example, thicknesses of general portions (hereinafter, referred to as other regions) of the contact member 116 are set to 4 [mm], and a length of the contact member 116 in the apparatus depth direction is set to 100 [mm]. A coefficient of linear expansion of an ABS resin is set to $74\times10^{-6}$/K which is a value that is greater than the coefficient of linear expansion of aluminum.

As shown in FIG. 1B, while the contact member 116 is supported within the cylindrical member 108, a groove 116B that extends in the apparatus depth direction is formed in the outer circumferential surface 118 of the contact member 116 on an opposite side of the separation space 116A with the axial center F of the cylindrical member 108 interposed therebetween.

Figure 1A:
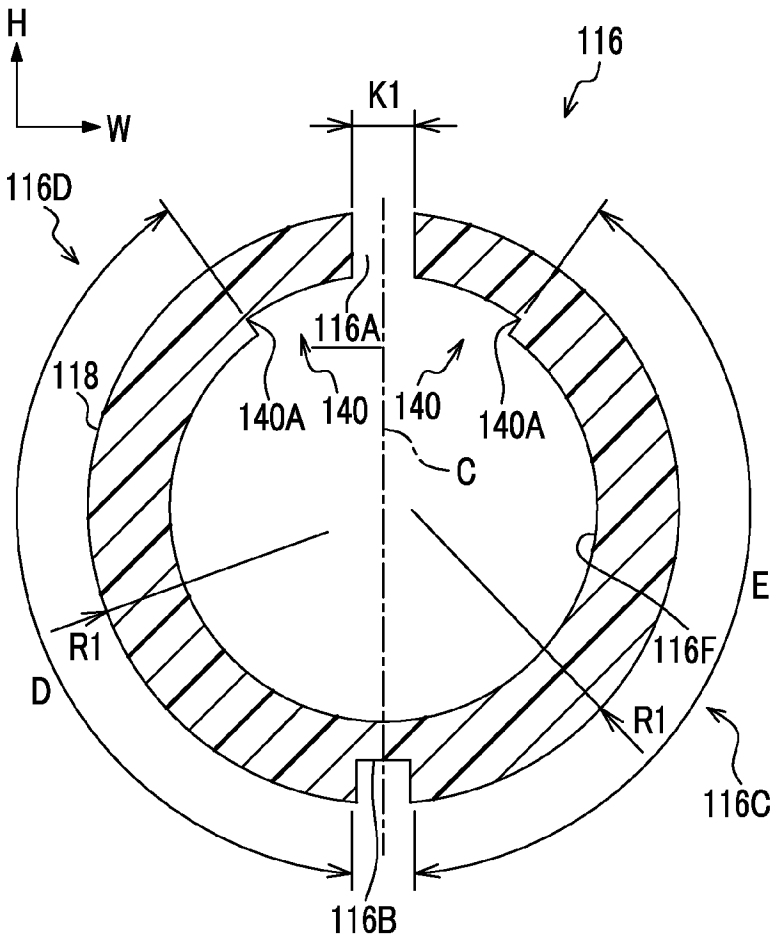

As shown in FIG. 1A, while the contact member 116 is not supported within the cylindrical member 108 (free state), the contact member 116 is formed to be bilaterally symmetric with respect to an axial line C passing the separation space 116A and the groove 116B when viewed in the apparatus depth direction. Specifically, the contact member 116 is formed such that an arc portion 116C having an arc shape on a right side in the drawing and an arc portion 116D having an arc shape on a left side in the drawing are connected through the groove 116B.

Thin-wall regions 140 (examples of thin-wall regions) that have thicknesses thinner than those of the other regions in the circumferential direction are respectively formed on both ends of the contact member 116 in the circumferential direction on an inner circumferential surface 116F of the contact member 116.

The other regions are regions which have the same thickness in the circumferential direction when viewed in the apparatus depth direction and have a central angle with respect to the axial center F that is 150 [degrees] or more while the contact member 116 is supported within the cylindrical member 108. In the first exemplary embodiment, a region D and a region E shown in FIG. 1A correspond to the other regions. That is, a sum of a central angle of the region D (θ3 of FIG. 1B) and a central angle of the region E is 150 [degrees] or more.

The thicknesses of the thin-wall regions 140 are the same within these regions, and, for example, are from 40% to 80% of the thicknesses of the other regions.

As shown in FIG. 1B, while the contact member 116 is supported within the cylindrical member 108, a point of one end of the contact member 116 which comes in contact with the inner surface 108A is expressed as G1, and a point of the other end of the contact member 116 which comes in contact with the inner surface 108A is expressed as G2. An angle θ1 formed by line segment FG1 that connects the axial center F and the point G1 and a line segment FG2 that connects the axial center F and the point G2 is, for example, from 2 degrees to 15 degrees.

A central point between the point G1 and the point G2 of the inner surface 108A when viewed in the apparatus depth direction is expressed as a point G3, and a line segment that connects the axial center F and the point G3 is expressed as a line segment FG3. Line segments that respectively incline the line segment FG3 by 22.5 degrees to right and left sides with the axial center F as its center are expressed as line segments FH, and line segments that incline the line segment FG3 by 45 degrees to the right and left sides with the axial center F as its center are expressed as line segments FJ. By doing this, ends 140A of the thin-wall regions 140 opposite to the both ends of the contact member 116 are respectively positioned between the line segments FH and the line segments FJ. The ends 140A of the pair of thin-wall regions 140 are symmetrically positioned.

A radius of the outer circumferential surface 118 of the arc portions 116C and 116D of the contact member 116 in the free state when viewed in the apparatus depth direction is expressed as R1, and a radius of the inner surface 108A of the cylindrical member 108 when viewed in the apparatus depth direction is expressed as R2 (see FIG. 1B). Thus, the radius R1 is equal to or greater than the radius R2.

Figure 3:
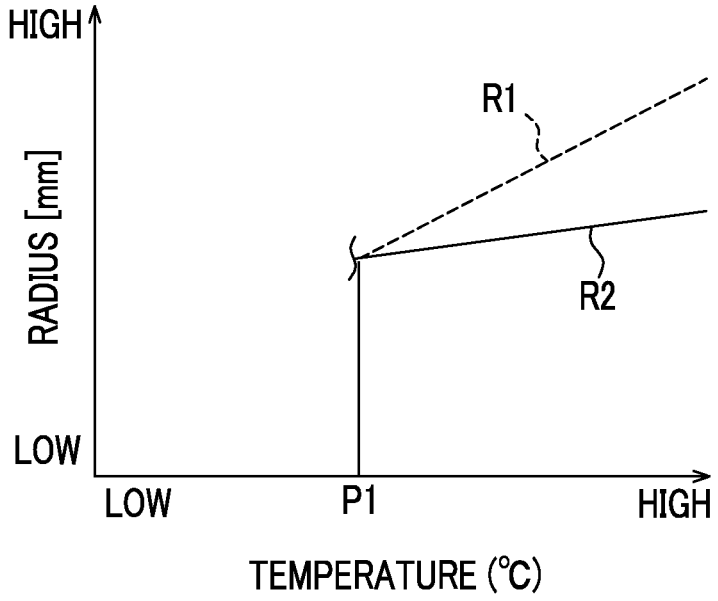
FIG. 3 is a graph showing a relationship between an ambient temperature and a radius of the contact member according to the first exemplary embodiment of the present invention.

FIG. 3 is a graph showing a relationship between an ambient temperature (horizontal line) and values of the radii R1 and R2 (vertical line), and in the graph, the radius R1 is depicted as a broken line and the radius R2 is depicted as a solid line. As mentioned above, the coefficient of linear expansion of the ABS resin used for the contact member 116 is set to $74\times10^{-6}$/K, and the coefficient of linear expansion of the aluminum in used for the cylindrical member 108 is $23\times10^{-6}$/K. For this reason, as the temperature is increased from P1 [° C.] in the graph, the radius R1 is increased more than the radius R2.

As stated above, the arc-shaped outer circumferential surface 118 of the contact member 116 comes in contact with the inner surface 108A of the cylindrical member 108 to press against the inner surface 108A, and, thus, the contact member 116 is supported by the cylindrical member 108. That is, the contact member 116 in a bent state is disposed within the cylindrical member 108, and the outer circumferential surface 118 of the contact member 116 comes in contact with the inner surface 108A of the cylindrical member 108 to press against the inner surface 108A. To achieve this, the radius R1 needs to be equal to the radius R2 or greater than R2, and the P1[° C.] of the graph shown in FIG. 3 is a lower limit value of an estimation temperature when the image holding member 56 is used.

A separation distance K1 between the both ends of the contact member 116 in the separation space 116A of the contact member 116 (see FIG. 1A) in the free state is longer than a separation distance K2 (see FIG. 1B) when the contact member 116 is supported within the cylindrical member 108.

In such a configuration, when the contact member 116 is disposed within the cylindrical member 108, the contact member 116 is gripped, and, thus, the groove 116B is deformed such that the separation distance K1 becomes short. The contact member 116 is bent, and the contact member 116 in this bent state is inserted into the cylindrical member 108. The gripping force exerted when gripping the contact member 116 is released, and the contact member 116 is inserted into the cylindrical member 108. Thus, the outer circumferential surface 118 of the contact member 116 comes in contact with the inner surface 108A of the cylindrical member 108 so as to allow the contact member 116 to be supported by the cylindrical member 108, and the contact member 116 is disposed inside the cylindrical member 108.

With such a configuration, when the surface of the image holding member 56 is charged, a superimposed voltage in which an alternating current voltage (1 kHz to 2 kHz) is superimposed on a direct current voltage is applied to the shaft 58A of the charge roll 58 from a power supply (see FIG. 4). Due to the alternating current voltage that forms the superimposed voltage, an alternating electric field is generated between the charge roll 58 and the image holding member 56. Thus, a periodic (2 kHz to 4 kHz) electrostatic attraction force is generated between the image holding member 56 and the charge roll 58. For this reason, a cross section of the cylindrical member 108 periodically changes (vibrate) between a circular shape and an elliptical shape. However, the contact member 116 whose outer circumferential surface 118 comes in contact with the inner surface 108A of the cylindrical member 108 is supported within the cylindrical member 108. For this reason, even though the cross section of the cylindrical member 108 is periodically changed, the vibration of the cylindrical member 108 is suppressed.

As stated above, it is possible to suppress the vibration of the cylindrical member 108 with the contact member 116, but the cylindrical member 108 may be deformed by supporting the contact member 116 within the cylindrical member 108.

Here, a contact member 200 according to a comparative example of the present first exemplary embodiment will be first described.

Figure 7B:
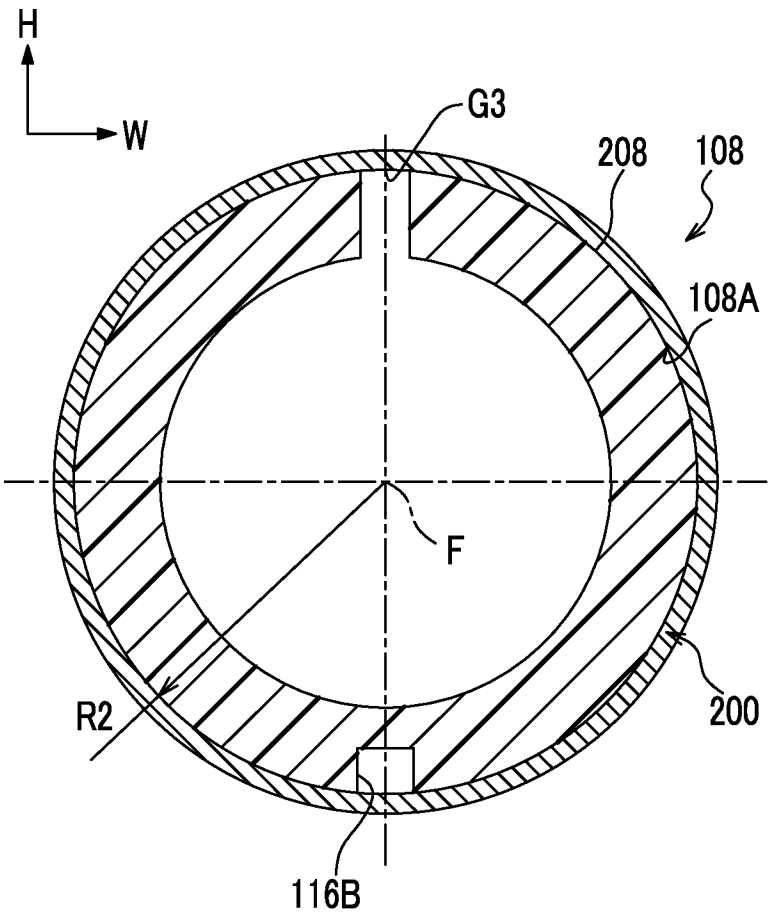
FIGS. 7A and 7B are cross-sectional views showing a contact member according to a comparative example of the first exemplary embodiment of the present invention.
Figure 7A:
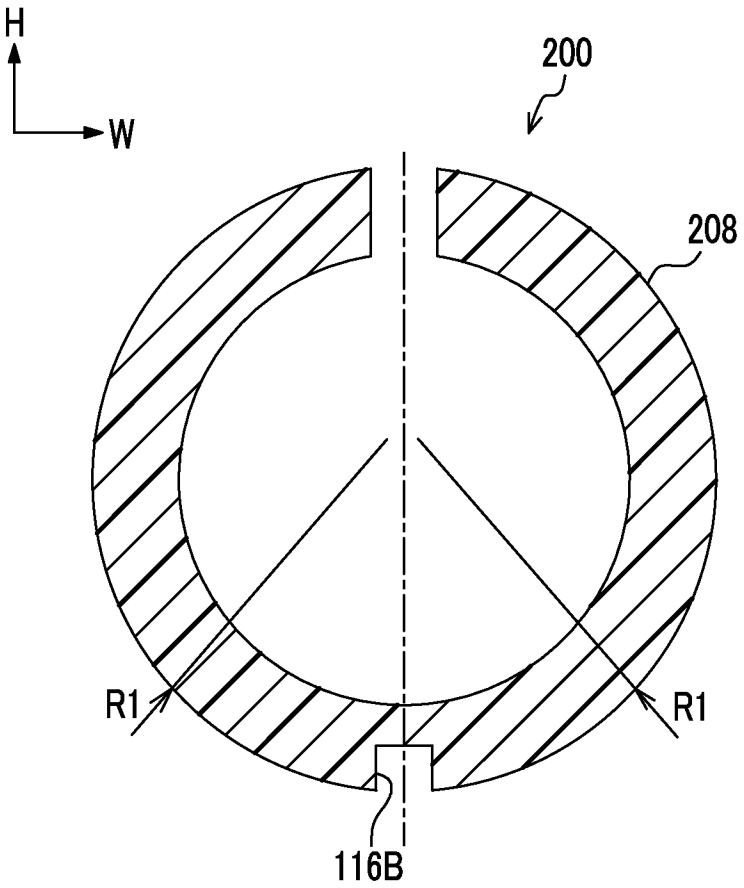

As shown in FIGS. 7A and 7B, the contact member 200 has the same shape as that of the contact member 116 except that the thin-wall regions 140 are not formed. As shown in FIG. 7B, an arc-shaped outer circumferential surface 208 of the contact member 200 comes in contact with the inner surface 108A of the cylindrical member 108 to press the inner surface 108A, and, thus, the contact member 200 is supported within the cylindrical member 108.

Here, pressing force that presses the inner surface 108A of the cylindrical member 108 by the outer circumferential surface 208 of the contact member 200 is varied in the circumferential direction of the contact member 200. Specifically, since the contact member 200 in the bent state is supported within the cylindrical member 108, pressing force on both ends (free ends) of the contact member 200 is higher than that in the other regions other than the both ends of the contact member 200 when viewed in the apparatus depth direction. Reaction force is generated on the inner surface 108A due to the pressing force on the both ends of the contact member 200. Due to the reaction force, pressing force that presses the inner surface 108A by a center of the contact member 200 in the circumferential direction is also increased.

Particularly, as the ambient temperature becomes high, since the radius R1 is greater than the radius R2 as compared to the case the ambient temperature is low, a difference between the aforementioned pressing forces is increased.

Figure 8:
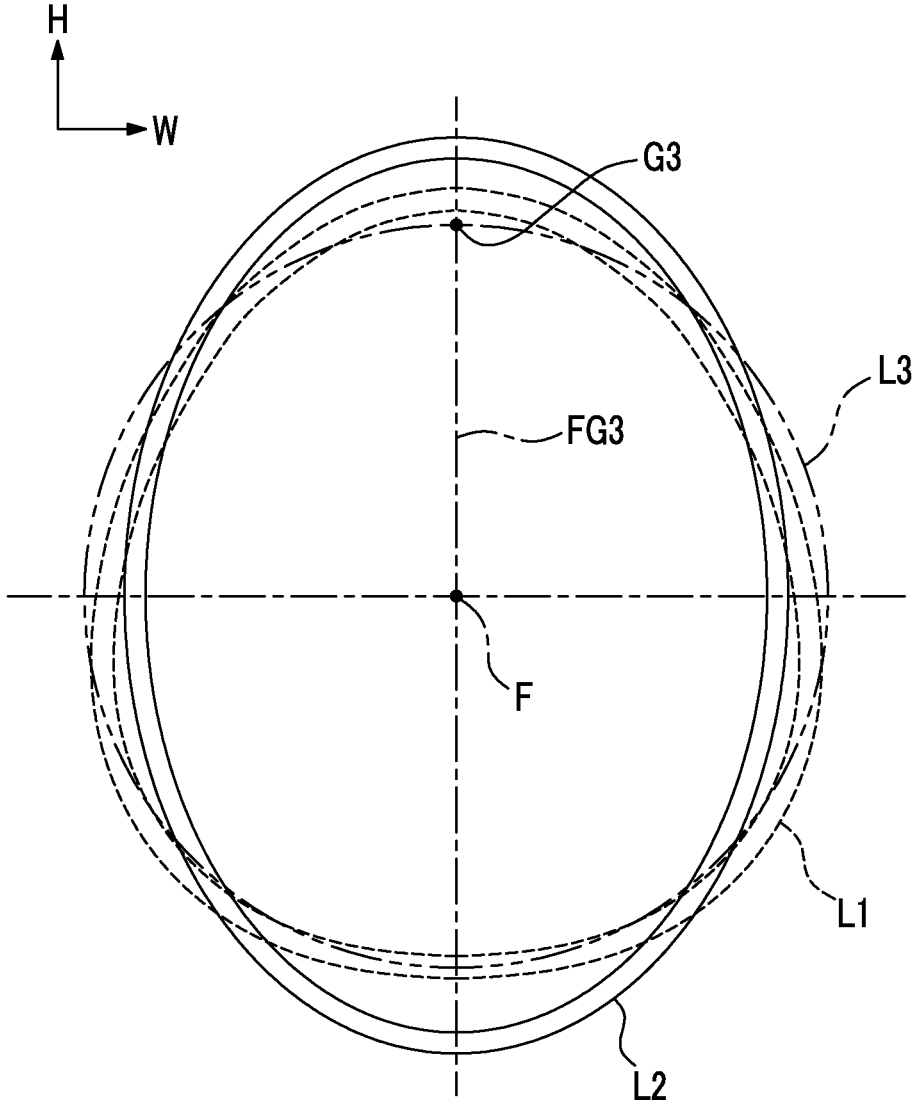
FIG. 8 is a diagram showing deformation of a cylindrical member that supports the contact member according to the comparative example of the first exemplary embodiment of the present invention therein.

The cross section of the cylindrical member 108 which is deformed when the inner surface 108A is pressed by the outer circumferential surface 208 of the contact member 200 is exaggeratedly illustrated in FIG. 8. An up and down direction in FIG. 8 is the same as an up and down direction in FIG. 7B. As mentioned above, in FIGS. 7A, 7B and 8, the upward and downward directions in the drawings are directions in which the line segment FG3 extends.

A broken line L1 in FIG. 8 indicates the deformation of the cylindrical member 108 when the contact member 200 is supported within the cylindrical member 108 at the lower limit value of the estimation temperature when the image holding member 56 is used, and a solid line L2 in FIG. 8 indicates the deformation of the cylindrical member 108 when the ambient temperature in the apparatus is increased. A dashed double-dotted line L3 in FIG. 8 indicates an external shape (circular shape) of the cylindrical member 108 prior to the deformation as a reference.

As stated above, the pressing force on the both ends in the circumferential direction of the contact member 200 is greater than the pressing force in the other regions other than the both ends. As the ambient temperature becomes high, the radius R1 becomes greater than the radius R2 as compared to the case where the ambient temperature is low. For this reason, the cylindrical member 108 (broken line L1 in the drawing) at the lower limit value of the estimation temperature when the image holding member 56 is used extends in the upward and downward direction in the drawing as compared to the cylindrical member 108 (dashed double-dotted line L3 in the drawing) before the deformation. The cylindrical member 108 (solid line L2 in the drawing) when the ambient temperature in the apparatus is increased extends further in the upward and downward direction in the drawing than the cylindrical member 108 (broken line L1 in the drawing) at the lower limit value of the estimation temperature when the image holding member 56 is used.

Figure 9:
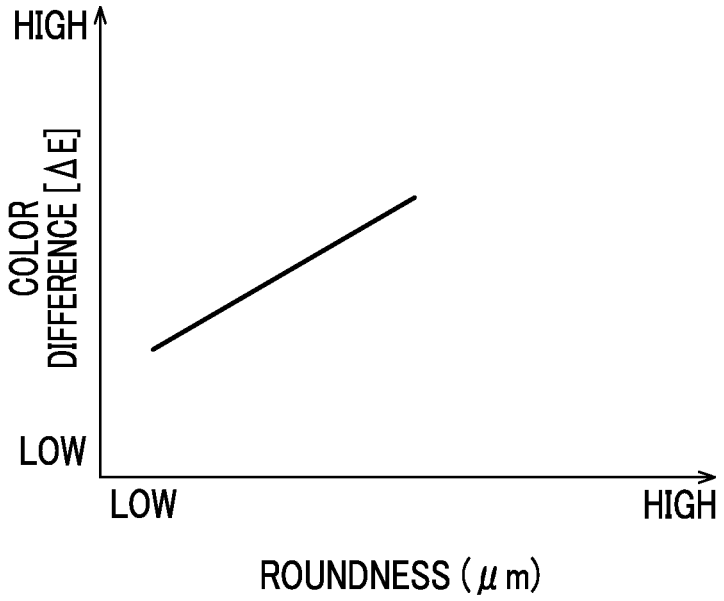
FIG. 9 is a graph showing a relationship between a color difference and deformation (roundness) of the cylindrical member that supports the contact member according to the comparative example of the first exemplary embodiment of the present invention therein.

As described above, since a portion of the cylindrical member 108 by which the contact member 200 is supported is deformed in an elliptical shape, roundness (JIS B 0621) of the cylindrical member 108 is increased. FIG. 9 is a graph showing a relationship between the roundness (JIS B 0621) (horizontal axis) of the cylindrical member 108 and a color difference [ΔE] (JIS Z28722: vertical axis) of a half tone image formed on the sheet member P using the image holding member 56 provided with the cylindrical member 108. As the color difference becomes higher, density non-uniformity is degraded.

From the graph, it may be seen that when the roundness of the cylindrical member 108 increases, the color difference becomes high, and, thus, density non-uniformity occurs.

As mentioned above, the thin-wall regions 140 having lower thicknesses than the other regions in the circumferential direction are respectively formed at the both ends of the contact member 116 of the first exemplary embodiment in the circumferential direction. For this reason, a difference between the pressing force at the both ends of the contact member 116 in the circumferential direction and the pressing force in the other regions is smaller than a difference between the pressing force at the both ends of the contact member 200 according to the comparative example in the circumferential direction and the pressing force in the other regions other than the both ends.

Accordingly, a variation in the pressing force that presses against the inner surface 108A of the cylindrical member 108 in the circumferential direction is suppressed.

The variation in the pressing force in the circumferential direction is suppressed, and, thus, the deformation of the cylindrical member 108 is further suppressed than in the case where the contact member 200 according to the comparative example is supported within the cylindrical member 108.

The deformation of the cylindrical member 108 is suppressed, and, thus, the occurrence of density non-uniformity in an output image caused by the deformation of the cylindrical member 108 is suppressed.

<Second Exemplary Embodiment>

Figure 10B:
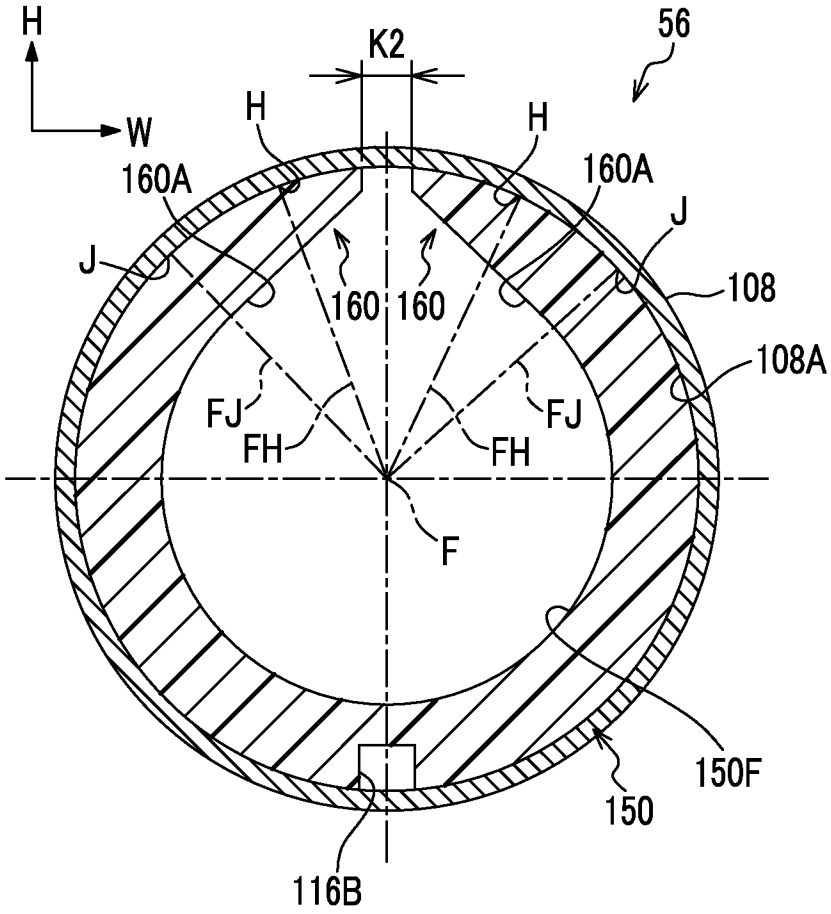
FIGS. 10A and 10B are cross-sectional views showing a contact member according to a second exemplary embodiment of the present invention.
Figure 10A:
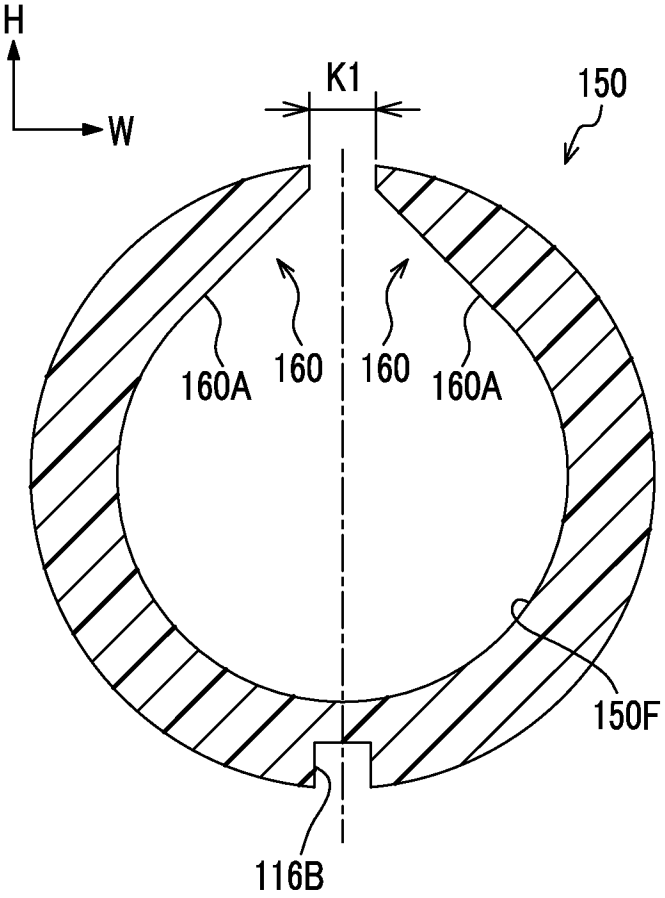

Next, examples of a contact member, an image holding member and an image forming apparatus according to the second exemplary embodiment of the present invention will be described with reference to FIGS. 10A and 10B. The same components as those in the first exemplary embodiment will be assigned the same reference numerals, and, thus the detailed description thereof will be omitted. Different components from those in the first exemplary embodiment will be mainly described.

On an inner circumferential surface 150F of a contact member 150 according to the second exemplary embodiment, thin-wall regions 160 (examples of thin-wall regions) having lower thicknesses than other regions are respectively formed at both ends of the contact member 150 in a circumferential direction.

When viewed in the apparatus depth direction, the thicknesses of the thin-wall regions 160 are the thinnest at the both ends of the contact member 150, gradually become thicker toward the groove 116B, and are the same as those in the other regions. That is, the thicknesses of the thin-wall regions 160 gradually change when viewed in the apparatus depth direction.

Thicknesses of portions having the lowest thicknesses in the thin-wall regions 160 are, for example, 50% or less of the thicknesses of the other regions. While the contact member 150 is supported by the cylindrical member 108, ends 160A (ends close to the groove 116B) of the thin-wall regions 160 are respectively positioned between line segments FH and line segments FJ, as shown in FIG. 10B.

In this way, the thicknesses of the thin-wall regions 160 are gradually changed, and, thus, the pressing force that presses the inner surface 108A by the thin-wall region 160 is gradually changed as compared to the case where thicknesses of ends at a center in the circumferential direction are sharply changed.

The pressing force against the inner surface 108A is gradually changed, and, thus, the deformation of the cylindrical member 108 is prevented from being partially concentrated unlike in the case where the pressing force is not gradually changed.

Other operations are the same as those in the first exemplary embodiment.

<Third Exemplary Embodiment>

Next, examples of a contact member, an image holding member and an image forming apparatus according to the third exemplary embodiment will be described with reference to FIGS. 11A and 11B. The same components as those in the first exemplary embodiment will be assigned the same reference numerals, and, thus, the detailed description thereof will be omitted. Different components from those in the first exemplary embodiment will be mainly described.

Figure 11B:
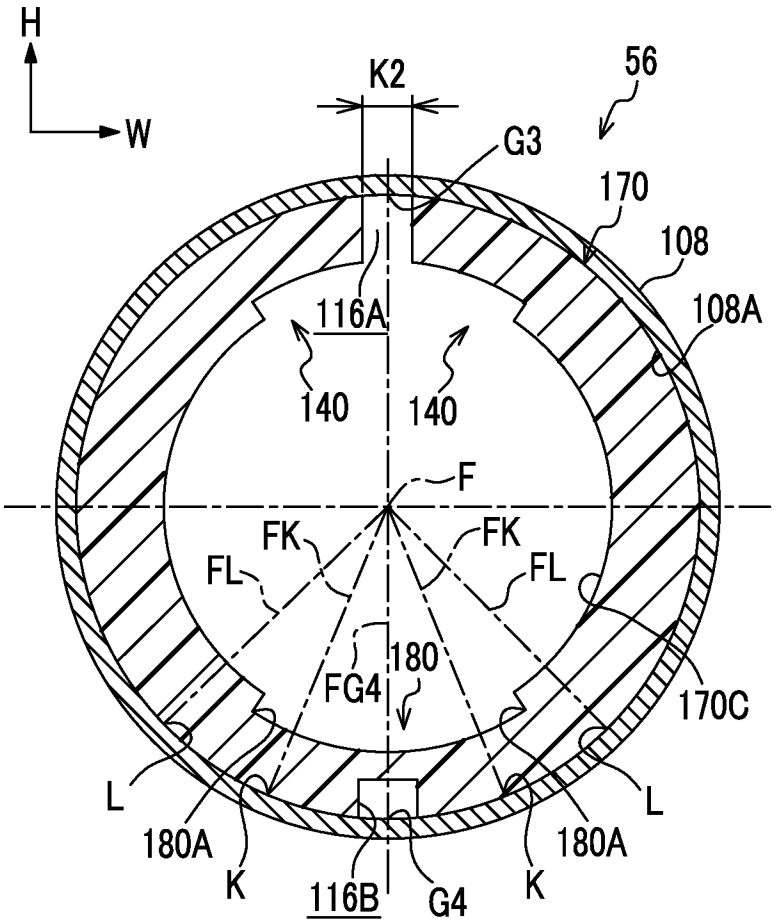
FIGS. 11A and 11B are cross-sectional views showing a contact member according to a third exemplary embodiment of the present invention.
Figure 11A:
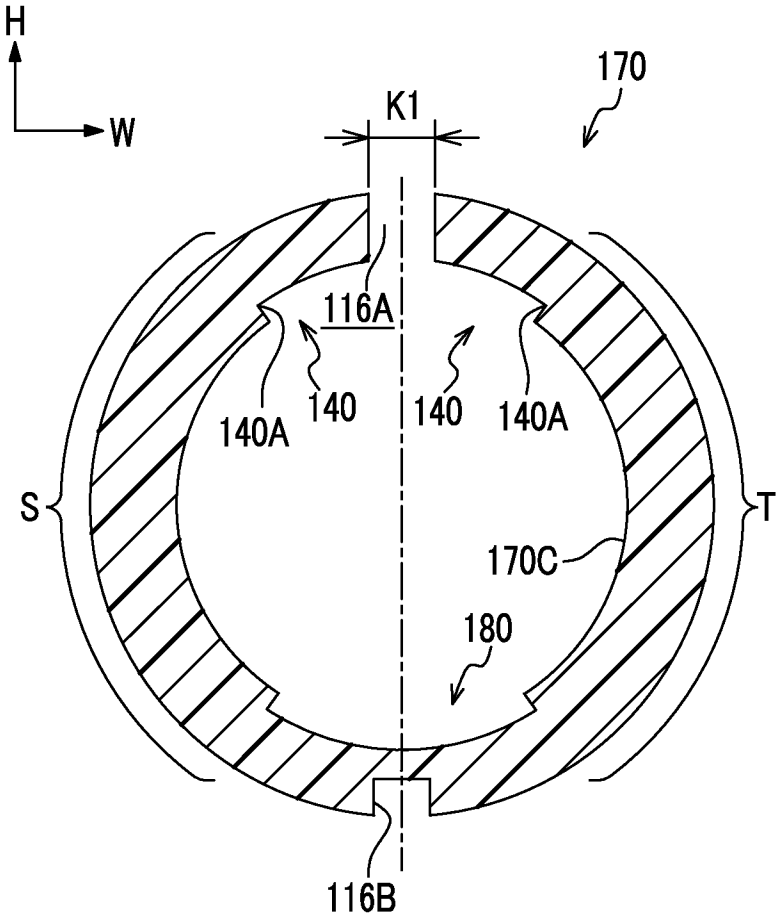

As shown in FIGS. 11A and 11B, thin-wall regions 180 (examples of thin-wall regions) having lower thicknesses than the other regions (regions S and T in the drawing) are respectively formed at a center of an inner circumferential surface 170C of a contact member 170 according to the third exemplary embodiment in a circumferential direction.

The thicknesses of the thin-wall regions 180 are the same in these regions, and are, for example, from 40% to 80% of those of the other regions.

When viewed in the apparatus depth direction, a point opposite to the point G3 on the inner surface 108A is expressed as a point G4, and a line segment that connects the axial center F and the point G4 is expressed as a line segment FG4. Line segments that respectively incline the line segment FG4 by 22.5 degrees to the right and left sides with the axial center F as its center are expressed as line segments FK, and line segments that respectively incline the line segment FG4 by 45 degrees to the right and left sides with the axial center F as its center are expressed as line segments FL. By doing this, ends 180A of the thin-wall regions 180 are respectively positioned between the line segments FK and the line segments FL.

As stated above, by forming the thin-wall regions 180, the thin-wall regions 140 press against the inner surface 108A, and due to the reaction force generated on the inner surface 108A, the pressing force that presses the inner surface 108A by the center of the contact member 170 in the circumferential direction is reduced. Thus, the deformation of the cylindrical member 108 is suppressed.

Other operations are the same as those in the first exemplary embodiment.

Although the present invention has been described in conjunction with the particular exemplary embodiments, the present invention is not limited to the exemplary embodiments. It will be apparent to those skilled in the art that other types of exemplary embodiments are possible within the scope of the present invention. For example, in the aforementioned exemplary embodiments, the cylindrical member 108 is made from aluminum which is a metal material, but may be made from other metal materials.

In the aforementioned exemplary embodiments, the contact member 116, 150 or 170 is made from an ABS resin, but may be made from other resin materials.

In the aforementioned exemplary embodiments, one contact member 116, 150 or 170 is disposed within the cylindrical member 108, but may be plural in number.

In the aforementioned exemplary embodiments, the outer circumferential surface of the contact member 116, 150 or 170 comes in contact with the inner surface 108A of the cylindrical member 108 over the entire region in the circumferential direction. However, plural protrusions may be formed on the outer circumferential surface of the contact member, and the protrusions may come in contact with the inner surface of the cylindrical member. In this case, the protrusions are required to be formed on the thin-wall regions and other regions.

In the aforementioned first and second exemplary embodiments, the thin-wall regions 140 or 160 are formed on the inner circumferential surface 116F or 150F of the contact member 116 or 150. However, the thin-wall regions may be formed on the outer circumferential surface of the contact member 116 or 150.

In the aforementioned third exemplary embodiment, the thin-wall regions 180 are formed on the contact member 116 of the first exemplary embodiment, but the thin-wall regions 180 may be formed on the contact member 150 of the second exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A contact member that comes in contact with an inner surface of a cylindrical member being rotated to press against the inner surface, is supported within the cylindrical member, is provided along the inner surface when viewed in an axial direction of the cylindrical member while being supported by the cylindrical member, has an arc shape in which both ends thereof face each other across an opening, and has first thin-wall regions which are respectively formed at both ends thereof in a circumferential direction to have thicknesses lower than thicknesses of other regions of the contact member, wherein the first thin-wall regions is a single piece and has a first thickness in the radial direction for a length starting at the opening and steps up to a second thickness in the radial direction, where the second thickness is greater than the first thickness.

2. The contact member according to claim 1, wherein when viewed in the axial direction, the thicknesses of the first thin-wall regions are thinnest at the both ends of the contact member and are the same as the thicknesses of the other regions of the contact member near a center of the contact member.

3. The contact member according to claim 1, wherein a second thin-wall region having a thickness lower than the thicknesses of the other regions of the contact member is formed at a center of an inner circumferential surface facing the inner surface in the circumferential direction.

4. The contact member according to claim 2, wherein a second thin-wall region having a thickness lower than the thicknesses of the other regions of the contact member is formed at a center of an inner circumferential surface of the contact member facing the inner surface in the circumferential direction.

5. An image holding member comprising:

the cylindrical member which is rotated, and in which a surface is charged and an image is formed on the charged surface; and the contact member according to claim 1 that comes in contact with an inside of the cylindrical member to be supported.

6. An image forming apparatus comprising:

the image holding member according to claim 5;

a charge member that charges the surface of the image holding member by applying a superimposed voltage in which an alternating current voltage is superimposed on a direct current voltage; and an image forming member that forms an image on the charged surface of the image holding member.

7. The contact member according to claim 1, wherein the thicknesses of the first thin-wall regions are from 40% to 80% of the thicknesses of the other regions of the contact member.

8. The contact member according to claim 1, wherein thickness of a portion having the lowest thicknesses in the second thin-wall regions is 50% or less of the thicknesses of the other regions of the contact member.

9. A contact member that comes in contact with an inner surface of a cylindrical member being rotated to press against the inner surface, is supported within the cylindrical member, is provided along the inner surface when viewed in an axial direction of the cylindrical member while being supported by the cylindrical member, has an arc shape in which both ends thereof face each other in a circumferential direction across an opening, and has first thin-wall regions which are respectively formed at both of the ends in the circumferential direction to have thicknesses in the radial direction lower than thickness in the radial direction of other regions of the contact member, Wherein the contact member is a single piece and, when viewed in the axial direction, the thickness of the first thin-wall regions are thinnest at the both ends of the contact member, gradually become thicker toward regions of the contact member which are near a center of the contact member in the circumferntial direction from the both ends, and wherein the contact member is deformed when inserted into the cylindrical member such that between the both ends of the contact member is a separation distance that is shorter when the contact member is disposed in the cylindrical member than when the contact member is not disposed in the cylindrical member.

10. The contact member according to claim 9, wherein a second thin-wall region having a thickness lower than the thicknesses of the other regions of the contact member is formed at a center of an inner circumferential surface of the contact member facing the inner surface in the circumferential direction.

11. An image holding member comprising:

the cylindrical member which is rotated, and in which a surface is changed and an image is formed on the charged surface; and the contact member according to claim 9 that comes in contact with an inside of the cylindrical member to be supported.

12. An image forming apparatus comprising:

the image holding member according to claim 11;

a charge member that charges the surface of the image holding member by applying a superimposed voltage in which an alternating current voltage is superimposed on a direct current voltage; and an image forming member that forms an image on the charged surface of the image holding member.

13. The contact member according to claim 9, wherein the thickness of the first thin-wall regions are from 40% to 80% of the thickness of the other regions of the contact member.

14. The contact member according to claim 9, wherein thickness of apportion having the lowest thicknesses in the first thin-wall regions is 50% or less of the thicknesses of the other regions of the contact member.

* * * * *